US006360832B1

(12) United States Patent
Overstreet et al.

(10) Patent No.: US 6,360,832 B1
(45) Date of Patent: Mar. 26, 2002

(54) HARDFACING WITH MULTIPLE GRADE LAYERS

(75) Inventors: James L. Overstreet, Webster; Ronald L. Jones, Cleveland; Alan J. Massey, Houston; Mary K. Adams, Spring, all of TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/477,029

(22) Filed: Jan. 3, 2000

(51) Int. Cl.[7] ..... E21B 10/08
(52) U.S. Cl. ..... 175/374; 175/425
(58) Field of Search ..... 175/374, 424, 175/425, 428

(56) References Cited

U.S. PATENT DOCUMENTS

| | | | | | |
|---|---|---|---|---|---|
| 4,243,727 | A | | 1/1981 | Wisler et al. | 428/558 |
| 4,562,892 | A | * | 1/1986 | Ecer | 175/371 |
| 4,610,320 | A | | 9/1986 | Beakley | 175/409 |
| 4,726,432 | A | | 2/1988 | Scott et al. | |
| 4,814,234 | A | | 3/1989 | Bird | 428/564 |
| 4,836,307 | A | | 6/1989 | Keshavan et al. | |
| 4,884,477 | A | | 12/1989 | Smith et al. | 76/108 |
| 4,940,099 | A | | 7/1990 | Deane et al. | 175/374 |
| 4,944,774 | A | | 7/1990 | Keshavan et al. | |
| 5,051,112 | A | | 9/1991 | Keshavan et al. | |
| 5,131,480 | A | * | 7/1992 | Lockstedt et al. | 175/374 |
| 5,152,194 | A | | 10/1992 | Keshavan et al. | |
| 5,161,335 | A | * | 11/1992 | Tank | 51/204 |
| 5,351,769 | A | | 10/1994 | Scott et al. | |
| 5,351,770 | A | * | 10/1994 | Cawthorne et al. | 175/374 |
| 5,351,771 | A | | 10/1994 | Zahradnik | |
| 5,379,853 | A | * | 1/1995 | Lockwod et al. | 175/428 |
| 5,445,231 | A | | 8/1995 | Scott et al. | |
| 5,492,186 | A | | 2/1996 | Overstreet et al. | |
| 5,579,856 | A | | 12/1996 | Bird | |
| 5,592,995 | A | * | 1/1997 | Scott et al. | 175/374 |
| 5,663,512 | A | | 9/1997 | Schader et al. | |
| 5,679,445 | A | | 10/1997 | Massa et al. | 428/212 |
| 5,791,422 | A | | 8/1998 | Liang et al. | |
| 5,791,423 | A | | 8/1998 | Overstreet et al. | |
| 5,967,248 | A | | 10/1999 | Drake et al. | 175/425 |
| 6,029,759 | A | | 2/2000 | Sue et al. | 175/374 |
| 6,050,354 | A | * | 4/2000 | Pessier et al. | 175/430 |
| 6,220,375 | B1 | * | 4/2001 | Butcher et al. | 175/428 |

* cited by examiner

*Primary Examiner*—David Bagnell
*Assistant Examiner*—Jennifer R. Dougherty
(74) *Attorney, Agent, or Firm*—Bracewell & Patterson, L.L.P.

(57) ABSTRACT

An earth-boring bit has hardfacing that has multiple grades and an overlapped portion. One of the layers is of a different grade than the other so as to provide more wear resistance. The other provides more toughness than the wear resistant layer. The more wear resistant layer has a greater volumetric density of carbide particles. The greater density is primarily achieved by using a majority of the particles of smaller dimension than in the less wear resistant hardfacing. The overlapped portion may be on an outer or gage end of the outer row of teeth.

20 Claims, 3 Drawing Sheets

HARDFACING WITH MULTIPLE GRADE LAYERS

TECHNICAL FIELD

This invention relates to improvement to earth-boring tools, especially to steel-tooth bits that use hardfacing containing carbide particles to enhance wear resistance.

BACKGROUND ART

The earliest rolling cutter earth-boring bits had teeth machined integrally from steel, conically shaped, earth disintegrating cutters. These bits, commonly known as "steel-tooth" or "mill-tooth" bits, are typically used for penetrating relatively soft geological formations of the earth. The strength and fracture-toughness of steel teeth permits the effective use of relatively long teeth, which enables the aggressive gouging and scraping action that is advantageous for rapid penetration of soft formations with low compressive strengths.

However, it is rare that geological formations consist entirely of soft material with low compressive strength. Often, there are streaks of hard, abrasive materials that a steel-tooth bit should penetrate economically without damage to the bit. Although steel teeth possess good strength, abrasion resistance is inadequate to permit continued rapid penetration of hard or abrasive streaks.

Consequently, it has been common in the art since at least the early 1930s to provide a layer of wear resistant metallurgical material called "hardfacing" over those portions of the teeth exposed to the severest wear. The hardfacing typically consists of extremely hard particles, such as sintered, cast or macrocrystalline tungsten carbide dispersed in a steel, cobalt or nickel alloy binder or matrix. Such hardfacing materials are applied by heating with a torch a tube of the particles that welds to the surface to be hardfaced a homogeneous dispersion of hard particles in the matrix. After hardfacing, the cone is preferably heat treated, which typically includes carburizing and quenching from a high temperature to harden the cone. The particles are much harder than the matrix but more brittle. After hardening, the matrix has a hardness preferably in the range from 53 to 68 Rockwell C (RC). The mixture of hard particles with a softer but tougher steel matrix is a synergistic combination that produces a good hardfacing.

There have been a variety of different hardfacing materials and patterns, including special tooth configurations, to improve wear resistance or provide self sharpening. Generally, the hardfacing applied to the teeth of new bits is in a pre-application ratio range of 50 to 80 percent carbide particles, typically about 70 percent, in a metal matrix of iron, nickel, cobalt or their alloys. The thickness of the hardfacing deposit on new bits is usually about 1/16 to 1/8 inch over the flanks, end portions and top of the crest of the tooth. Portions of the hardfacing may be somewhat thicker. The thicker portions are generally where the flanks intersect the crest. These thicker portions may be up to double that of other areas.

U.S. Pat. No. 5,791,423 teaches a thicker portion at the corner that is an intersection of the leading flank with the outer end. The patent indicates extra thick portions can be formed by applying a second layer of hardfacing over a first layer before the initial layer cools to room or ambient temperature. The first and second layers of hardfacing are applied from the same hardfacing rod. U.S. Pat. No. 4,726,432 discloses hardfacing the leading flanks of teeth with a larger particle size hardfacing, and hardfacing the trailing flanks of teeth with a smaller particle size, more wear resistant hardfacing. The difference in hardfacing causes a self-sharpening effect. U.S. Pat. No. 5,492,186 teaches hardfacing on an inner end, crest and extending over onto the outer end with a first hardfacing. The remaining portion of the outer or gage end is hardfaced with another hardfacing that is more wear resistant.

SUMMARY OF INVENTION

The earth-boring bit of this invention has at least one hardfaced region that has a first layer of hardfacing of a first grade of carbide particles within a metal matrix. A second layer of hardfacing has an overlapped portion overlaid with at least a portion of the first layer. The second layer also has carbide particles within a metal matrix. However, the second layer is of a different grade than the first grade. The first grade of hardfacing is tougher, but has less wear resistance than the second layer. The second layer has more wear resistance than the first layer.

In the preferred embodiment, the second layer has a carbide particle density that is greater than the first layer. Density, as used herein, refers to the average total volume of carbide particles within a unit volume of matrix metal. Preferably, both layers are made up of a majority of sintered tungsten carbide particles. One manner in which to achieve different density is by using different particle sizes in the first and second types of hardfacing. In the preferred embodiment, the majority of particles of the first layer are larger in average size or volume than the majority of the particles of the second layer, resulting in a lesser density. The bit also has portions that contain a single layer of hardfacing. The single layers may be of the same hardfacing as the first layer or the second layer.

DESCRIPTION OF THE PREFERRED EMBODIMENT

Figure 1:
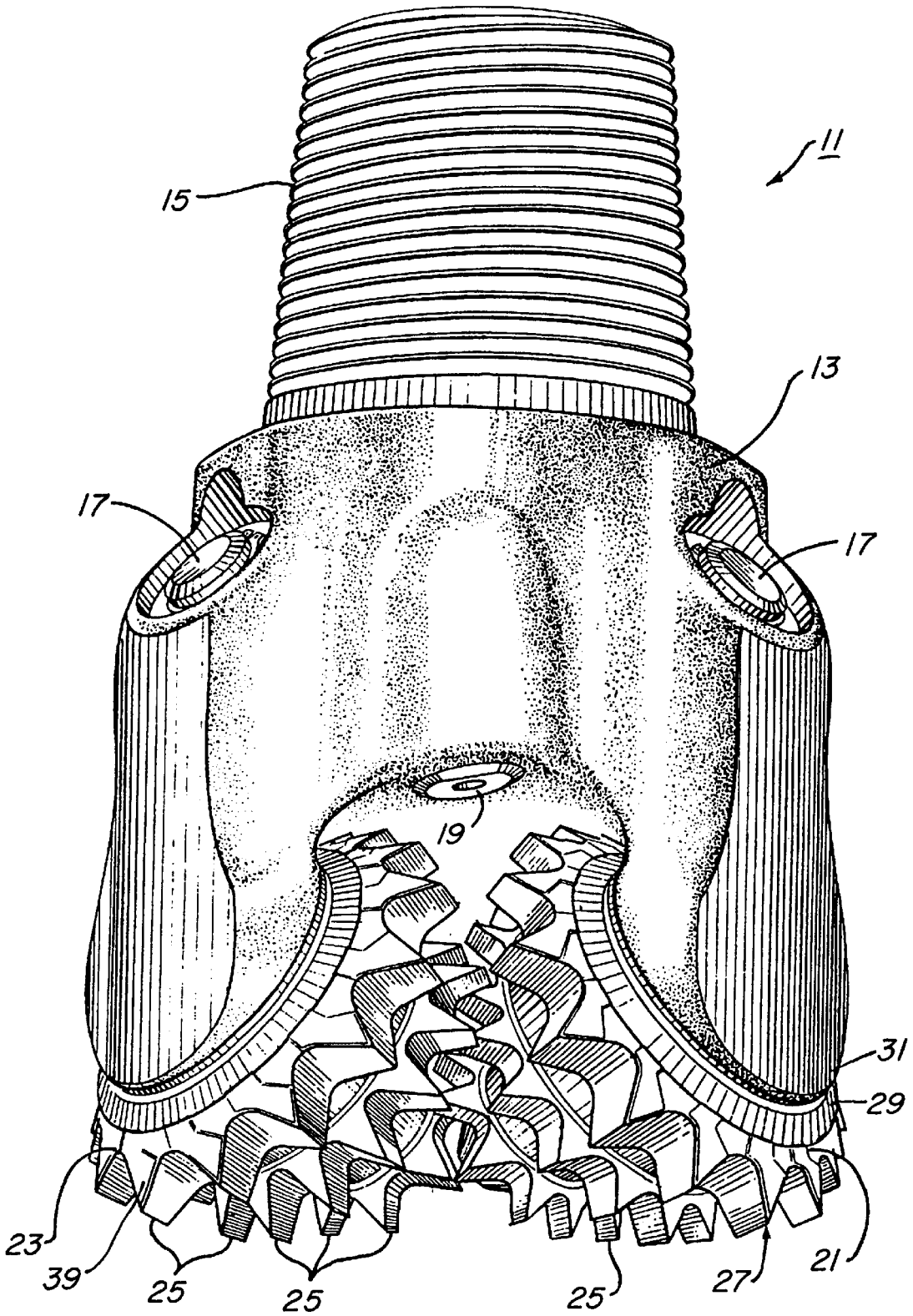
FIG. 1 is a side elevation of an earth-boring bit having hardfacing in accordance with this invention.

Referring to FIG. 1, an earth-boring bit 11 modified in accordance with the present invention is depicted. Earth-boring bit 11 includes a bit body 13 having threads 15 at its upper extent for connecting bit 11 into a drill string (not shown). Each leg of bit 11 is provided with a lubricant compensator 17. At least one nozzle 19 is provided in bit body 13 for directing pressurized drilling fluid from within the drill string and bit 11 against the bottom of the bore hole.

Cutters 21, 23, generally three (one of which is obscured from view in FIG. 1), are rotatably secured to respective legs of bit body 13. A plurality of inner row teeth 25 and outer row teeth 27 are arranged in generally circumferential rows on cutters 21, 23, being integrally formed on the cutters, usually by machining. Outer or heel row teeth 27 are located at the outer edges of each cutter 21, 23 adjacent gage surfaces 29. Each bit leg has a shirttail portion 31 on its outer side adjacent gage surface 29 of cutters 21, 23. Typically, hardfacing will be applied to inner row teeth 25, heel row teeth 27, gage surface 29 and also to shirttail 31.

Figure 2:
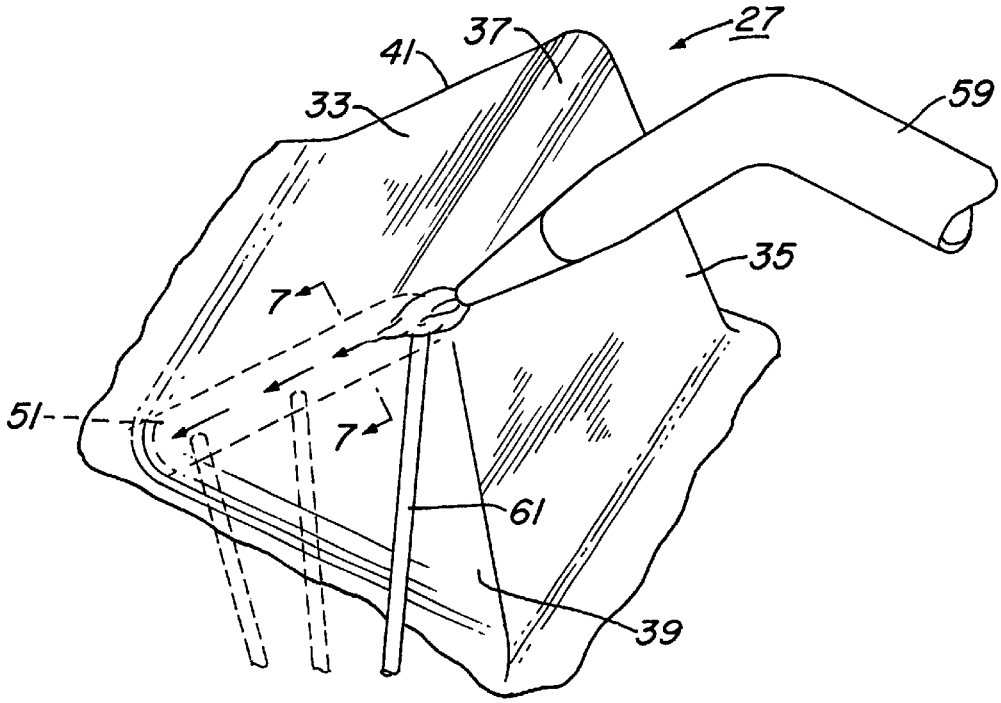
FIG. 2 is a perspective view of one tooth of one of the cutters of the bit of FIG. 1, showing the hardfacing layer being applied.

Referring to FIG. 2, each heel row tooth 27 has a leading flank 33, considering the direction of rotation of cutters 21, 23, and a trailing flank 35. Leading flank 33 faces into the direction of rotation. Leading flank 33 and trailing flank 35 incline and converge toward each other, joining at a crest 37. An outer or gage end 39 is located at the outer side adjacent gage surface 29 (FIG. 1), and an inner end 41 is located opposite outer end 39.

Figure 3:
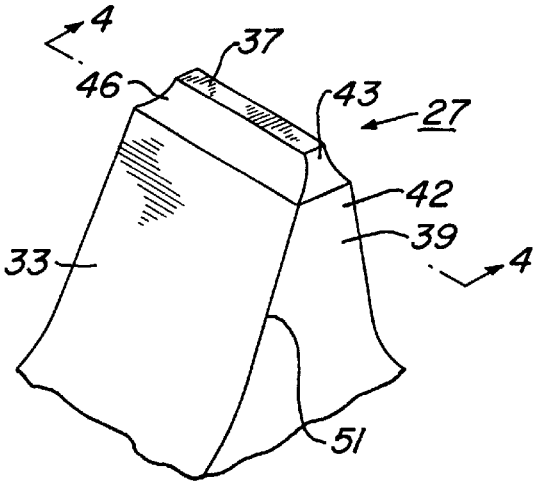
FIG. 3 is a view a perspective view of the tooth of FIG. 2 shown prior to being hardfaced.

Referring to FIG. 3, the underlying steel body 42 of tooth 27 has an outer end recess 43 that extends across outer end 39 at the intersection with crest 37. Preferably, there is also an inner end recess 45 (FIG. 4) that extends across inner end 41 at the intersection with crest 37. Inner end recess 45 is shown having the same radial dimension as outer end recess 43, however they could differ. Each of the leading and trailing flanks 33, 35 may also have a recess 46 at crest 37. Recesses 43, 45 and 46 are all preferably concave depressions having a radius.

Figure 4:
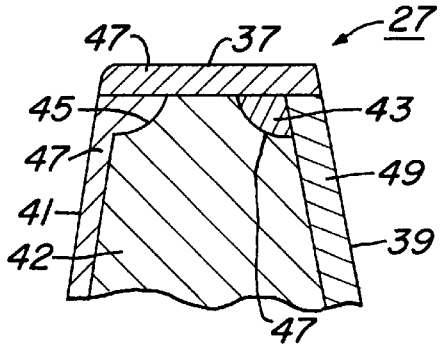
FIG. 4 is a partial sectional view of the tooth of FIG. 2, taken along the line 4—4 of FIG. 3.

Preferably, hardfacing is applied over the entire heel row tooth 27. In the first embodiment, a first grade of hardfacing 47 is applied to leading and trailing flanks 33, 35, recesses 43, 45, 46, and inner end 41. Than a second grade of hardfacing 49 is applied over outer end 39, with a portion of second layer 49 overlapping or laid over portions of first grade 47. One overlapped portion, shown by the dotted lines in FIG. 2, is on a corner 51 of leading flank 33 with outer end 39. Second grade 49 extends over first grade 47 from the base of tooth 27 to crest 37 at corner 51. Also, an overlapped portion exists over outer end recess 43, as shown in FIG. 4. Second grade 49 extends over the entire outer end 39, from the root of tooth 27 to crest 37. Then a layer of first grade hardfacing 47 is applied on crest 37. The application of first grade 47 is thus on all portions of tooth 27 except outer end 39. First grade 47 will be thicker at recesses 43, 45 and 46 than on trailing flank 35 and inner end 41.

Second grade 49 is of a different grade of hardfacing than first grade 47, being selected to provide more wear resistance than first grade 47. On the other hand, first grade 47 is selected to have more toughness or resistance to fracturing than second grade 49. This is primarily accomplished by increasing the density of the carbide particles of second grade 49 over the density of carbide particles in first grade 47. That is, there will be more volume of carbide particles per unit volume in second grade 49 than in first grade 47. In the preferred embodiment, the density is increased in one manner by having the majority of carbide particles in second grade 49 being smaller than the majority of carbide particles in first grade 47. The term "majority" as used herein means by comparison in weight, not in total number of particles, because the carbide particles in the first and second layers 47, 49 may be made up of multiple sizes. If so, the size that makes up the majority of particles in each of the hardfacing layers 47, 49 by weight compared to the total weight of the other particles, will differ in dimension between the two hardfacing layers 47, 49. The smaller size carbide particles can be more tightly packed together than larger particles, resulting in less matrix metal and thus a greater volume density per unit volume.

In one example, first grade 47 in a pre-application ratio has the following components:

70% 16/30 mesh sintered carbide pellets

15% 20/30 mesh crushed sintered carbide

15% 60/80 mesh crushed cast carbide

Nominal fill in rod 70% by weight

Second grade 49 in the same example has the following components:

70% 30/40 mesh sintered carbide pellets

15% 30/40 mesh crushed sintered carbide

15% 60/80 mesh crushed cast carbide

Nominal fill in rod 65% by weight

In both grades, the sintered carbide pellets refer to spherical pellets or granules that have a generally spherical shape. These pellets are not true spheres, but lack the corners, sharp edges, and angular projections commonly found in crushed and other non-spherical carbide grains or particles. Sintered carbide pellets comprise crystals or particles of tungsten carbide sintered together with a binder, usually cobalt, into a generally spherical pellet configuration. The majority (85% in the above example) of the carbide particles of first grade 47 are in mesh sizes of 16/30, while the majority (also 85%) of the carbide particles of second grade 49 are in mesh sizes of 30/40 mesh. Thus the majority of the carbide particles of first grade 47 are larger in average dimension or volume than the majority of the second grade 49.

Generally, another way to accomplish higher density is to increase the amount of fill in the rod, which is the percentage of carbide particles by weight to the steel alloy body of the rod. The steel alloy forms the matrix for the hardfacing. In this first example, the percentage of fill for second grade 49 is 65% by weight, while the fill for first grade 47 is 70% by weight. If the carbide particles in each rod were the same size, the rod with the higher percentage of fill by weight would be more dense. However, because of the smaller particle size, second grade 49 is still more dense than first grade 47 even though it has less fill.

Figure 7:
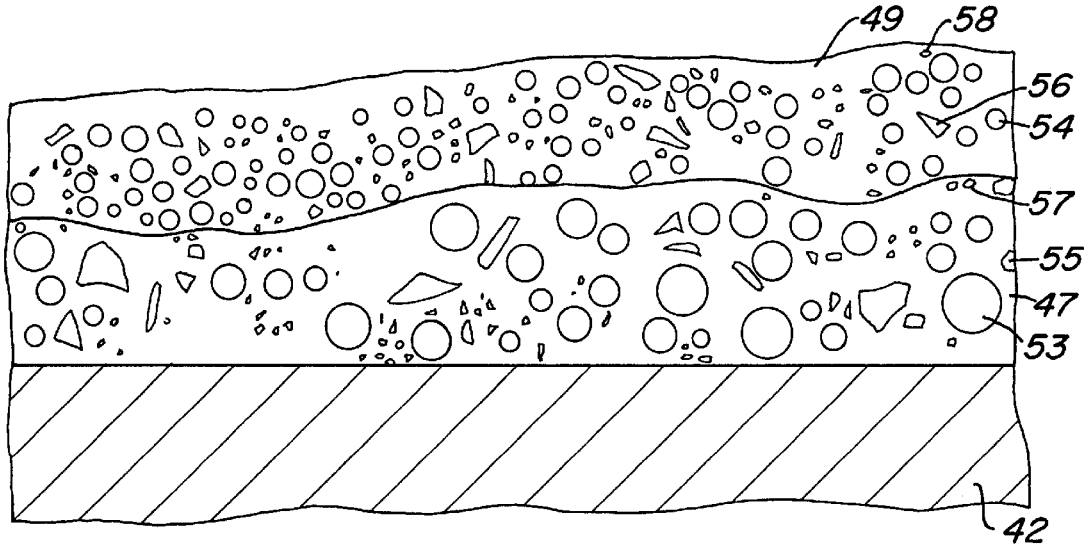
FIG. 7 is an enlarged sectional view showing two hardfacing layers laid on the tooth of FIG. 2 in accordance with this invention.

FIG. 7 is a drawing depicting an enlarged photomicrograph view of layers 47, 49 over tooth body 42. Spherical carbide pellets 53 appear generally circular in first grade 47. The spherical sintered carbide pellets 54 in second grade 49 are also spherical but smaller in volume than pellets 53. Crushed sintered carbide particles 55 in first grade 47 are also larger in average dimension than crushed sintered carbide particles 56 in second grade 49. Crushed cast carbide particles 57 in first grade 47 are of the same average dimension as crushed cast carbide particles 58 in second grade 49 in this embodiment.

FIG. 2 illustrates how hardfacing layers 47, 49 may be applied. Preferably, they are applied by a torch 59, which is used to melt the steel alloy of a rod 61. Rod 61 is shown made up of a pre-application ratio of the hardfacing for second grade 49 as set forth above. Another rod (not shown) will be made up in accordance with a hardfacing mix in accordance with first grade 47. The first grade 47 is applied first with torch 59, then before first grade 47 cools to ambient or room temperature, second grade 49 will be applied with torch 59. Some of it will overlie first grade 47 as shown in FIG. 4, and some of it will overlie only underlying tooth body 42. In FIG. 2, second grade 49 is shown being applied to corner 51. Subsequently, first grade 47 is applied to crest 37, with a portion overlying second grade 49 on outer end 39.

Alternately, first grade 47 could be initially applied over the entire tooth 27. Then second grade 49 could be overlaid on first grade 47 in a rectangular strip just at corner 51 (FIG.

2) and not on outer end 39. Also, a larger diameter rod could be used for first grade 47 than second grade 49. This may produce a significantly smaller crest radius, making the tooth sharper, if desired. Additionally, first grade 47 may also be applied on some of the inner row teeth 25 (FIG. 1) and/or shirttail 31. Alternately, second grade 49 could also be employed on portions of inner row teeth 25, if desired, or another hardfacing entirely could be used.

There are other hardfacing combinations that are available. As a second example, one other combination is set forth below:

First Hardfacing Grade 47

70% 16/30 mesh sintered carbide pellets

15% 20/30 mesh crushed sintered carbide

15% 60/80 mesh spherical cast carbide

70% fill by weight

Second Grade 49

40% 30/40 mesh sintered carbide pellets

10% 30/40 mesh crushed sintered carbide

50% 60/80 mesh spherical cast carbide

70% fill by weight

The cast carbide in both of these embodiments comprises a tungsten carbide formed in a generally spherical or rounded form. In this example, second grade 49 will be more wear resistant than in the first example.

Figure 5:
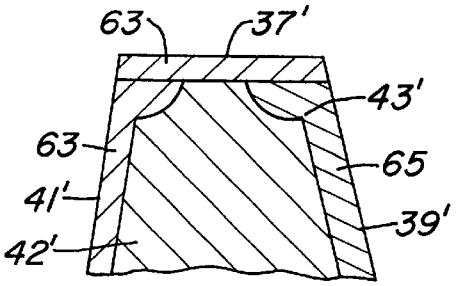
FIG. 5 is a sectional view similar to FIG. 4, but showing an alternate embodiment of the hardfaced tooth.

FIG. 5 shows a different arrangement of hardfacing for tooth body 42' of tooth 27. Second hardfacing grade 65 extends only over outer end 39', including filling recess 43'. First hardfacing grade 63 extends over the entire body 42' except for outer end 39'. Inner end 41' and crest 37' will thus have only first hardfacing grade 63. There is an overlapped portion where crest 37' overlays the upper end of second grade 65 at recess 43'. First hardfacing grade 63 may be tougher, but less wear resistant, while second hardfacing grade 65 will be more wear resistant. Hardfacing grades 63, 65 may be of the grades set forth in the examples above.

Figure 6:
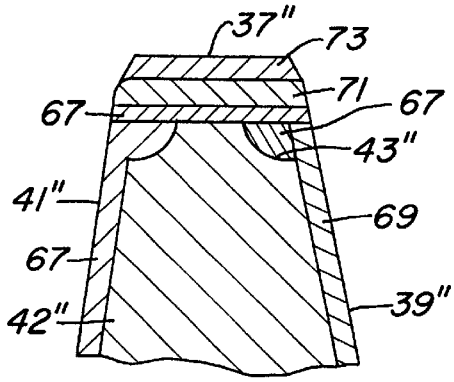
FIG. 6 is another sectional view similar to FIG. 4, but showing a second alternate embodiment of a tooth hardfaced in accordance with this invention.

In FIG. 6, another arrangement of hardfacing is shown applied to tooth body 42". First hardfacing grade 67 extends over the entire tooth body 42", except for the portion of outer end 39" below recess 43". First grade 67 thus covers inner end 41" and outer end recess 43". Second hardfacing grade 69 extends over the portion of outer end 39" below recess 43" and also overlaps the portion of first grade 67 within recess 43". Then a layer of first grade hardfacing 67 is applied on crest 37". First and second grades 67, 69 thus cover the same portions as in the embodiment shown in FIG. 4. In this embodiment, however, a third grade 71 extends only over first grade 67 at crest 37". Further, a fourth grade 73 extends only over third grade 71 at crest 37".

In the embodiment of FIG. 6, preferably first grade 67 has less carbide density and thus more toughness than any of the other layers 69, 71, 73. For example, it may comprise 100% sintered carbide spherical pellets in a 20 mesh size, nominally filled within a rod to 60%. Third hardfacing grade 71 is preferably more wear resistant than first grade 67, but not as wear resistant as second or fourth grades 69, 73. For example, it could have the same grade as first grade 47 (FIG. 4) described above. Fourth grade 73 is preferably more wear resistant than first grade 67 and third grade 71, but not as much as second grade 69. Fourth grade 73, for example, might be the same as the first example of second grade 49 (FIG. 4). Second grade 69 may be the same as the second example of hardfacing grade 49 (FIG. 4) as described above. Thus in this example, in order of wear resistance, the most wear resistant would be second grade 69, then fourth grade 73, then third grade 71, and then first grade 67.

The invention has significant advantages. By overlaying different grades of hardfacing, a tough supporting layer that also has wear resistance may be used in combination with highly wear resistant portions of an earth-boring bit. In the overlapped areas, when one of the layers wears through, the other layer will then provide wear resistance. The less resistant hardfacing layer typically is less expensive, reducing the overall hardfacing material cost, particularly on larger diameter bits. By using different diameter rods, a sharper crest for the tooth may be achieved.

While the invention has been shown in only a few of its forms, it should be apparent to those skilled in the art that it is not so limited, but is susceptible to various changes without departing from the scope of the invention.

We claim:

1. An earth-boring bit having at least one hardfaced region comprising:

a first layer of hardfacing of a first grade having carbide particles within a metal matrix;

a second layer of hardfacing having an overlapped portion overlapped with the first layer, wherein one of the layers overlays and is separated from underlying support metal of the bit by the other of the layers, the second layer having carbide particles within a metal matrix and being of a second grade that has greater wear resistance than the first grade; and the hardfaced region includes a portion that contains only the first hardfacing layer bonded to the underlying support metal and another portion that contains only the second layer bonded to the underlying support metal.

2. An earth-boring bit having at least one hardfaced region comprising:

a first layer of hardfacing of a first grade having carbide particles within a metal matrix; and a second layer of hardfacing having an overlapped portion overlapped with the first layer, wherein one of the layers overlays and is separated from underlying support metal of the bit by the other of the layers, the second layer having carbide particles within a metal matrix and being of a second grade that has greater wear resistance than the first grade; wherein:

the bit has at least one rotatable cutter having a plurality of teeth, each tooth having inner and outer ends, and leading and trailing flanks converging to define a crest;

the hardfaced region is located on the inner and outer ends and the leading and trailing flanks of the teeth; and the second layer overlays the first layer at a corner of an intersection of the leading flank and the outer end of at least some of the teeth, defining the overlapped portion.

3. An earth-boring bit having at least one hardfaced region comprising:

a first layer of hardfacing of a first grade having carbide particles within a metal matrix;

a second layer of hardfacing having an overlapped portion overlapped with the first layer, the second layer having carbide particles within a metal matrix and being of a second grade that has greater wear resistance than the first grade; wherein:

the bit has at least one rotatable cutter having a plurality of teeth, each tooth having inner and outer ends, and leading and trailing flanks converging to define a crest; wherein at least some of the teeth have an outer end recess located adjacent the crest on the outer end;

the first layer extends over the inner end and crest and fills the outer end recess; and the second layer extends over the outer end and is overlaid on the portion of the first layer in the outer end recess, forming the overlapped portion.

4. An earth-boring bit having at least one hardfaced region comprising:

a first layer of hardfacing of a first grade having carbide particles within a metal matrix;

a second layer of hardfacing having an overlapped portion overlapped with the first layer, the second layer having carbide particles within a metal matrix and being of a second grade that has greater wear resistance than the first grade; and wherein:

the bit has at least one rotatable cutter having a plurality of teeth, each tooth having inner and outer ends, and leading and trailing flanks converging to define a crest; wherein at least some of the teeth have an outer end recess located adjacent the crest on the outer end;

the second layer extends over the outer end and fills the outer end recess; and the first layer extends over the inner end and crest, with a portion of the first layer on the crest being overlaid on the portion of the second layer that fills the outer end recess, forming the overlapped portion.

5. An earth-boring bit having at least one hardfaced region comprising:

a first layer of hardfacing of a first grade having carbide particles within a metal matrix; and a second layer of hardfacing having an overlapped portion overlapped with the first layer, wherein one of the layers overlays and is separated from underlying support metal of the bit by the other of the layers, the second layer having carbide particles within a metal matrix and being of a second grade that has greater wear resistance than the first grade; wherein the hardfaced region includes a portion that contains only the first hardfacing layer bonded to the underlying support metal and another portion that contains only the second layer bonded to the underlying support metal; and wherein the second layer in the overlapped portion is overlaid on top of the first layer.

6. An earth-boring bit having at least one hardfaced region comprising:

a first layer of hardfacing of a first grade having carbide particles within a metal matrix; and a second layer of hardfacing having an overlapped portion overlapped with the first layer, wherein one of the layers overlays and is separated from underlying support metal of the bit by the other of the layers, the second layer having carbide particles within a metal matrix and being of a second grade that has greater wear resistance than the first grade; and wherein the majority by weight of carbide particles of the first layer comprises sintered carbide particles having a selected mesh size dimension and the majority by weight of the carbide particles of the second layer comprises spherical sintered carbide pellets having a smaller mesh size dimension than the sintered carbide particles of the first layer.

7. An earth-boring bit having at least one hardfaced region comprising:

first layer of hardfacing of a first grade having carbide particles within a metal matrix; and a second layer of hardfacing having an overlapped portion overlapped with the first layer, wherein one of the layers overlays and is separated from underlying support metal of the bit by the other of the layers, the second layer having carbide particles within a metal matrix and being of a second grade that has greater wear resistance than the first grade; wherein the bit has at least one rotatable cutter having a plurality of teeth, wherein the hardfaced region is on a portion of at least some of the teeth, and wherein each of the teeth having the hardfaced region also has single-layer hardfacing on other portions of said teeth.

8. An earth-boring bit, comprising:

a bit body;

at least one cutter rotatably secured to the bit body, the cutter including a plurality of teeth formed integrally with the cutter and arranged in circumferential rows on the cutter;

each of the teeth in an outer row on the cutter having inner and outer ends, and leading and trailing flanks converging to define a crest, with a corner being located at an intersection of the outer end with the crest; and a hardfaced region on the teeth of the outer row, the hardfaced region having a first layer of carbide particles in a metal matrix and a second layer of carbide particles in a metal matrix, the first layer having a lesser volumetric density of carbide particles than the second layer; and wherein the first and second layers have an overlapped portion on the corners of the teeth of the outer row wherein the layers overlap each other, with one of the layers overlaying and being separated from underlying support metal of the teeth by the other of the layers.

9. The earth-boring bit of claim 8, wherein the majority by weight of carbide particles of the first layer comprises sintered carbide particles having a selected mesh size dimension and the majority by weight of the carbide particles of the second layer comprises spherical carbide pellets having a smaller mesh size dimension than the sintered carbide particles of the first layer.

10. The earth-boring bit of claim 9, wherein each of the layers comprises spherical sintered carbide pellets and crushed carbide particles, and wherein the spherical sintered carbide pellets of the first layer have an average size greater than the spherical sintered carbide pellets of the second layer.

11. The earth-boring bit of claim 8, wherein the second layer is overlaid on the first layer at the overlapped portion.

12. An earth-boring bit, comprising:

a bit body;

at least one cutter rotatably secured to the bit body, the cutter including a plurality of teeth formed integrally with the cutter and arranged in circumferential rows on the cutter;

each of the teeth in an outer row on the cutter having inner and outer ends, and leading and trailing flanks converging to define a crest;

a hardfaced region on the teeth of the outer row, the hardfaced region having a first layer of carbide particles in a metal matrix and a second layer of carbide particles in a metal matrix, the first layer having a lesser volumetric density of carbide particles than the second layer;

wherein the first and second layers have an overlapped portion on the outer ends of the teeth of the outer row wherein the layers overlap each other;

each of the teeth of the outer row has an outer end recess located on the outer end adjacent the crest;

the overlapped portion is located at the recess;

the first layer extends over the inner end, crest and fills the outer end recess; and the second layer extends over the outer end and the portion of the first layer that fills the outer end recess, defining the overlapped portion.

13. The earth-boring bit of claim 12, wherein:

a third layer of hardfacing extends over the second layer at the crest, the third layer having a greater volumetric density of carbide particles than the first layer.

14. The earth-boring bit of claim 13, wherein:

a fourth layer of hardfacing extends over the third layer of hardfacing at the crest, the fourth layer having a greater volumetric density of carbide particles than the third layer.

15. An earth-boring bit, comprising:

a bit body;

at least one cutter rotatably secured to the bit body, the cutter including a plurality of teeth formed integrally with the cutter and arranged in circumferential rows on the cutter;

each of the teeth in an outer row on the cutter having inner and outer ends, and leading and trailing flanks converging to define a crest;

a hardfaced region on the teeth of the outer row, the hardfaced region having a first layer of carbide particles in a metal matrix and a second layer of carbide particles in a metal matrix, the first layer having a lesser volumetric density of carbide particles than the second layer;

wherein the first and second layers have an overlapped portion on the outer ends of the teeth of the outer row wherein the layers overlap each other;

each of the teeth of the outer row has an outer end recess located on the outer end adjacent the crest;

the overlapped portion is located at the recess;

the second layer extends over the outer end and fills the outer end recess; and the first layer extends over the inner end and crest, with a portion of the first layer on the crest overlaying the second layer to define the overlapped portion.

16. An earth-boring bit, comprising:

a bit body;

at least one cutter rotatably secured to the bit body, the cutter including a plurality of teeth formed integrally with the cutter and arranged in circumferential rows on the cutter;

each of the teeth in an outer row on the cutter having inner and outer ends, and leading and trailing flanks converging to define a crest; and a hardfaced region on the teeth of the outer row, the hardfaced region having a first layer of carbide particles in a metal matrix on the inner end and the crest and a second layer of carbide particles in a metal matrix on the outer end, the first layer having a lesser volumetric density of carbide particles than the second layer; and wherein the second layer is overlaid on the first layer extending along a corner at a junction of the leading flank and the outer end.

17. An earth-boring bit, comprising:

a bit body;

at least one cutter rotatably secured to the bit body, the cutter including a plurality of teeth formed integrally with the cutter and arranged in circumferential rows on the cutter;

each of the teeth in an outer row on the cutter having inner and outer ends, and leading and trailing flanks converging to define a crest;

a hardfaced region on the teeth of the outer row, the hardfaced region having a first layer of carbide particles in a metal matrix on the inner end and the crest and a second layer of carbide particles in a metal matrix on the outer end, the first layer having a lesser volumetric density of carbide particles than the second layer; wherein the second layer is overlaid on the first layer extending along a corner at a junction of the leading flank and the outer end;

each of the teeth of the outer row have an outer end recess located on the outer end adjacent the crest;

the first and second layers are overlaid at the recess;

the first layer extends over the inner end, crest and fills the outer end recess; and the second layer extends over the outer end and the portion of the first layer that fills the outer end recess.

18. An earth-boring bit having at least one hardfaced region comprising:

a first layer of hardfacing of a first grade having carbide particles within a metal matrix;

a second layer of hardfacing having an overlapped portion overlapped with the first layer, the second layer having carbide particles within a metal matrix and being of a second grade that has greater wear resistance than the first grade; wherein:

the bit has at least one rotatable cutter having a plurality of teeth, each tooth having inner and outer ends, and leading and trailing flanks converging to define a crest; wherein at least some of the teeth have an outer end corner located adjacent the crest on the outer end;

the first layer extends over the inner end and crest and covers the outer end corner; and the second layer extends over the outer end and is overlaid on the portion of the first layer on the outer end corner, forming the overlapped portion.

19. An earth-boring bit having at least one hardfaced region comprising:

a first layer of hardfacing of a first grade having carbide particles within a metal matrix;

a second layer of hardfacing having an overlapped portion overlapped with the first layer, the second layer having carbide particles within a metal matrix and being of a second grade that has greater wear resistance than the first grade; and wherein:

the bit has at least one rotatable cutter having a plurality of teeth, each tooth having inner and outer ends, and leading and trailing flanks converging to define a crest; wherein at least some of the teeth have an outer end corner located adjacent the crest on the outer end;

the second layer extends over the outer end and the outer end corner; and the first layer extends over the inner end and crest, with a portion of the first layer on the crest being overlaid on the portion of the second layer that covers the outer end corner, forming the overlapped portion.

20. An earth-boring bit, comprising:

a bit body;

at least one cutter rotatably secured to the bit body, the cutter including a plurality of teeth formed integrally with the cutter and arranged in circumferential rows on the cutter;

each of the teeth in an outer row on the cutter having inner and outer ends, and leading and trailing flanks converging to define a crest;

a hardfaced region on the teeth of the outer row, the hardfaced region having a first layer of carbide particles in a metal matrix on the inner end and the crest and a second layer of carbide particles in a metal matrix on the outer end, the first layer having a lesser volumetric density of carbide particles than the second layer; wherein the second layer is overlaid on the first layer extending along a flank corner at a junction of the leading flank and the outer end;

each of the teeth of the outer row have an outer end corner located on the outer end adjacent the crest;

the first and second layers are overlaid at the outer end corner;

the first layer extends over the inner end, crest and the outer end corner; and the second layer extends over the outer end and the portion of the first layer that covers the outer end corner.

* * * * *